US006168893B1

(12) United States Patent
Nakamura et al.

(10) Patent No.: US 6,168,893 B1
(45) Date of Patent: Jan. 2, 2001

(54) ELECTROPHOTOGRAPHIC PHOTOCONDUCTOR AND METHOD FOR PRODUCTION THEREOF

(75) Inventors: Yoichi Nakamura; Shinjirou Suzuki; Hideki Kina; Akira Ootani, all of Kawasaki (JP)

(73) Assignee: Fuji Electric Imaging Device Co., Ltd., Nagano (JP)

( * ) Notice: Under 35 U.S.C. 154(b), the term of this patent shall be extended for 0 days.

(21) Appl. No.: 09/432,812

(22) Filed: Nov. 4, 1999

(30) Foreign Application Priority Data

Nov. 4, 1998 (JP) ..... 10-313747

(51) Int. Cl.[7] ..... G03G 5/04

(52) U.S. Cl. ..... 430/83; 430/58.05; 430/133; 430/970; 430/56

(58) Field of Search ..... 430/970, 83, 58.05, 430/56, 133, 134

(56) References Cited

U.S. PATENT DOCUMENTS 3,917,546 11/1975 Vogl .
4,741,981 5/1988 Hashimoto et al. .
5,945,243 * 8/1999 Nakamura et al. ..... 430/970

FOREIGN PATENT DOCUMENTS 3625766 2/1987 (DE) .
9-059193 3/1997 (JP) .

OTHER PUBLICATIONS

"P/O Ligand Systems: Synthesis, Reactivity, and Structure of Tertiary o–Phosphanylphenol Derivatives" Heinicke et al. Chem. Ber, 1996, 129, pp. 1547–1560.

* cited by examiner

*Primary Examiner*—Christopher D. Rodee
(74) *Attorney, Agent, or Firm*—Venable; Robert J. Frank

(57) ABSTRACT

There is provided an electrophotographic photoconductor whose stability has been improved by incorporating an aryloxydiarylphosphine compound into a layer having a charge transport material. There is also provided a method for producing an electrophotographic photoconductor, which can improve the stability of a coating liquid for formation of a photosensitive layer by incorporating the aryloxydiarylphosphine compound into the coating liquid.

10 Claims, 1 Drawing Sheet

ELECTROPHOTOGRAPHIC PHOTOCONDUCTOR AND METHOD FOR PRODUCTION THEREOF

This application is based on Patent Application No. 10-313747 (1998) filed Nov. 4, 1998 in Japan, the content of which is incorporated hereinto by reference.

BACKGROUND OF THE INVENTION

1. Field of the Invention

This invention relates to an electrophotographic photoconductor and a method for its production. More specifically, the invention relates to an electrophotographic photoconductor for use in a printer, a copier, or a facsimile of the electrophotographic type having a photosensitive layer containing an organic material on a conductive substrate; and a method for producing the electrophotographic photoconductor.

2. Description of the Related Art

An electrophotographic photoconductor is required to have the function of retaining a surface charge in the dark, the function of accepting light to generate a charge, and the function of accepting light to transport a charge. The electrophotographic photoconductors are classified into a single-layered photoconductor with a photosensitive layer which, as a single layer, has all of these functions, and a laminated photoconductor with a photosensitive layer which is a double-layered structure comprising a layer mainly dedicated to charge generation, and a layer contributing to retention of a surface charge in the dark, and to charge transport when accepting light.

To form an image by electrophotography using such an electrophotographic photoconductor, the Carlson process, for example, is used. Image formation by this process is performed by charging by corona discharge to the photoconductor in the dark; formation of an electrostatic image, such as characters or graphics of a document, on the surface of the charged photoconductor; development of the resulting electrostatic image with toner; and transfer, followed by fixation, of the developed toner image onto a support such as paper. The photoconductor after transfer of the toner image is reused after static elimination, removal of the remaining toner, and optical static elimination.

Photosensitive materials so far used in the electrophotographic photoconductors include inorganic photoconductive substances, such as selenium, selenium alloy, zinc oxide, or cadmium sulfide, dispersed in resin binders; organic photoconductive substances, such as poly-N-vinylcarbazole, 9,10-anthracenediolpolyester, hydrazone, stilbene, butadiene, benzidine, phthalocyanine, or bis-azo compounds, dispersed in resin binders; and those photoconductive substances deposited by vacuum evaporation or sublimation.

It is publicly known to add various additives to the photosensitive layer, as desired, thereby improving the electrophotographic characteristics. As examples of phosphorus compound additives, phosphite compounds have been known publicly. Such compounds are disclosed in German Patent Publication No. 3625766.

As described above, various studies have been done on how to improve stability of electrophotographic photoconductors by addition of additives. However, these studies have not been fully successful.

Under these circumstances, it is an object of the present invention to provide an electrophotographic photoconductor improved in stability by using an additive hitherto unknown for addition to electrophotographic photoconductors, and a method for producing the electrophotographic photoconductor in which the stability of a coating liquid for formation of a photosensitive layer has been improved.

SUMMARY OF THE INVENTION

The present inventors conducted extensive studies in an attempt to solve the problems with the prior art. They found, in an electrophotographic photoconductor having a photosensitive layer containing a charge transport material on a conductive substrate, that when an aryloxydiarylphosphine compound was incorporated into the photosensitive layer, the electrophotographic characteristics became markedly stable. Based on this finding, they accomplished an electrophotographic photoconductor according to the present invention.

The inventors also found, in a method for producing an electrophotographic photoconductor including the step of applying a coating liquid containing a charge transport material onto a conductive substrate to form a photosensitive layer, that when an aryloxydiarylphosphine compound was incorporated into the coating liquid, the stability of the coating liquid was markedly improved. Based on this finding, they accomplished a method according to the present invention.

In the first aspect of the present invention, there is provided an electrophotographic photoconductor having a photosensitive layer on a conductive substrate, the photosensitive layer comprising a layer containing a charge transport material and an aryloxydiarylphosphine compound.

Here, the content of the aryloxydiarylphosphine compound may be 0.005 to 20 parts by weight per the 100 parts by weight of the charge transport material and a resin binder in the layer containing the charge transport material and the aryloxydiarylphosphine compound. More preferably, the content of the aryloxydiarylphosphine compound is 0.01 to 10 parts by weight per the 100 parts by weight of the charge transport material and a resin binder in the layer containing the charge transport material and the aryloxydiarylphosphine compound.

The aryloxydiarylphosphine compound may be 2,4-di-tert-butylphenoxydiphenylphosphine or 2,6-di-tert-butylphenoxydiphenylphosphine.

In another aspect of the present invention, there is provided a method for producing an electrophotographic photoconductor, including the step of applying a coating liquid containing a charge transport material onto a conductive substrate to form a photosensitive layer, the method further comprising incorporating an aryloxydiarylphosphine compound into the coating liquid.

The above and other objects, effects, features and advantages of the present invention will become more apparent from the following description of the embodiments thereof taken in conjunction with the accompanying drawings.

DETAILED DESCRIPTION OF PREFERRED EMBODIMENTS

A concrete constitution of the photoconductor according to the present invention will be described by reference to FIG. 1A and FIG. 1B.

Electrophotographic photoconductors include a negatively charged laminated photoconductor, a positively charged laminated photoconductor, and a positively charged single-layered photoconductor. The negatively charged laminated photoconductor will be taken as an example for description of the present invention. Substances and methods for the formation or production of the photoconductor, except those concerned with an aryloxydiarylphosphine compound, may be suitably selected from publicly known substances and methods.

Figure 1A:
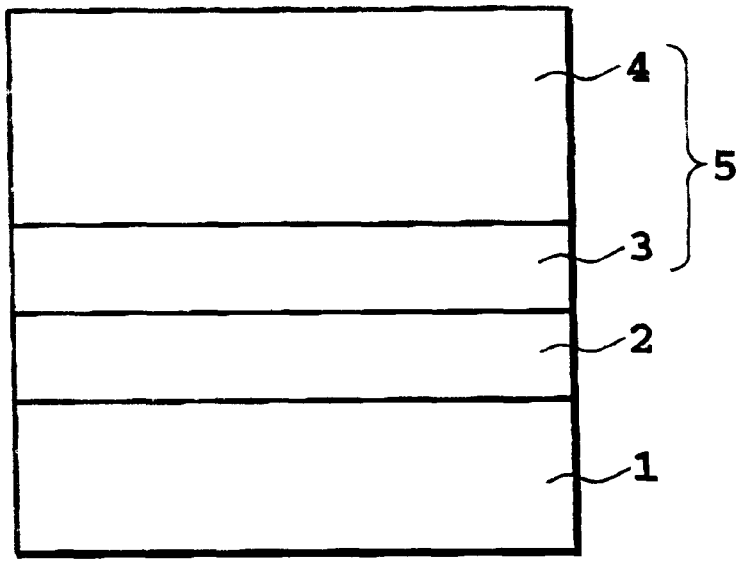
FIG. 1A is a schematic sectional view of a laminated electrophotographic photoconductor as an example of an electrophotographic photoconductor according to the present invention.
Figure 1B:
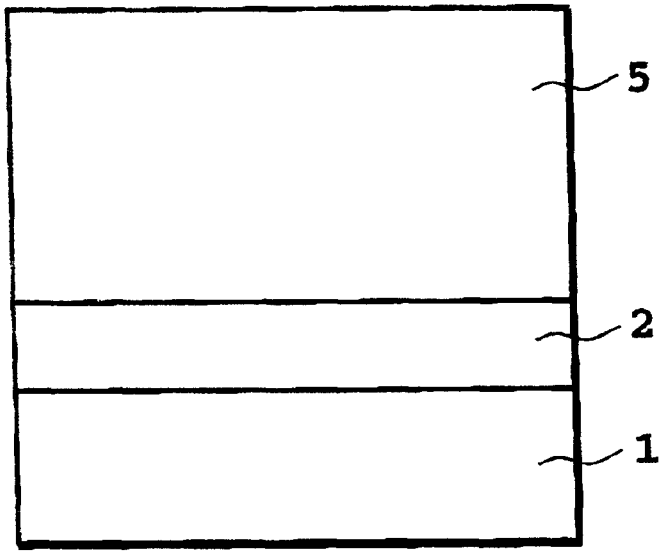
FIG. 1B is a schematic sectional view of a single-layered electrophotographic photoconductor as an example of an electrophotographic photoconductor according to the present invention.

FIGS. 1A and 1B are sectional views of typical electrophotographic photoconductors, in which FIG. 1A shows a double-layered, laminated electrophotographic photoconductor, while FIG. 1B shows a single-layered electrophotographic photoconductor. With the negatively charged laminated electrophotographic photoconductor (FIG. 1A), an undercoat 2 is formed, as desired, on a conductive substrate 1. On the undercoat 2, a photosensitive layer 5 is laminated which comprises a charge generation layer 3 and a charge transport layer 4 arranged in this order, the charge generation layer 3 having the function of generating a charge, and the charge transport layer 4 having the function of transporting a charge. With the positively charged single-layered electrophotographic photoconductor (FIG. 1B), an undercoat 2 is similarly formed on a conductive substrate 1. On the undercoat 2, a single photosensitive layer 5 is laminated which has both the function of generating a charge and the function of transporting a charge. Neither type of photoconductor necessarily needs the undercoat 2. The photosensitive layer 5 of these photoconductors contains a charge transport material which accepts light and transports a charge.

The conductive substrate 1 serves as an electrode of the photoconductor, and concurrently serves as a support for the other layers. The conductive substrate 1 may be in the form of a cylinder, a plate or a film. The material for the conductive substrate 1 may be a metal, such as aluminum, stainless steel, nickel or an alloy of any of these, or may be glass or synthetic resin onto which electrically conducting treatment has been applied.

As the undercoat 2, alcohol soluble polyamide, solvent soluble aromatic polyamide, or thermosetting urethane resin may be used. Preferred as the alcohol soluble polyamide includes copolymeric compounds of nylon 6, nylon 8, nylon 12, nylon 66, nylon 610, and nylon 612, and N-alkyl-modified or N-alkoxyalkyl-modified nylons. Concrete compounds are Amilan CM8000 (6/66/610/12 copolymeric nylon, manufactured by TORAY INDUSTRIES Co., Ltd.), Elbamide 9061 (6/66/612 copolymeric nylon, manufactured by Du Pont Japan Co., Ltd.), and Diamide T-170 (copolymeric nylon consisting essentially of nylon 12, manufactured by DAICEL HUELS Co., Ltd.). To the undercoat 2, an inorganic fine powder, such as $TiO_2$, alumina, calcium carbonate, or silica, may be added.

The charge generation layer 3 is formed by coating particles of a charge generation substance as such, or together with a resin binder dispersed in a solvent. The charge generation layer 3 accepts light to generate a charge. It is important for the charge generation layer 3 to have a high efficiency of charge generation, and to cause high injection of the generated charge into the charge transport layer 4. Desirably, the charge generation layer 3 is minimally dependent on an electric field, and gives high injection of a charge even in a low electric field. Examples of the charge generation substance are various pigments or dyes, such as phthalocyanine, azo, quinone, indigo, cyanine, squarylium, and azulene compounds. A thickness of the charge generation layer 3 depends on the optical absorption coefficient of the charge generation substance and generally, is 5 $\mu$m or less, and preferably 1 $\mu$m or less.

The charge generation layer 3 contains the charge generation substance, and may further contain a charge transport material. The resin binder for the charge generation layer includes, for example, polymers or copolymers, such as polycarbonate, polyesters polyamide, polyurethane, epoxy resin, polyvinyl butyral, phenoxy resin, silicone, methacrylate resin, vinyl chloride resin, ketal resin, and vinyl acetate resin; and halogenated compounds or cyanoethyl compounds of these polymers or copolymers. These resin binders may be used in a suitable combination. The amount of the charge generation substance used is 10 to 5,000 parts by weight, preferably 50 to 1,000 parts by weight, per 100 parts by weight of the resin binder.

The charge transport layer 4 is a coated film comprising a material formed by dissolving a charge transport material into a resin binder. Examples of the charge transport material are hydrazone compounds, styryl compounds, amine compounds, and their derivatives which are used alone or in combination. The charge transport layer 4 retains the charge of the photoconductor by serving as an insulating layer when in the dark. When accepting light, the charge transport layer 4 functions to transport the charge injected from the charge generation layer. As the resin binder for the charge transport layer, polycarbonate, polyester, polystyrene, a polymer or copolymer of methacrylic acid ester is used. It is important for the resin binder to have compatibility with the charge transport material, in addition to mechanical, chemical and electrical stability as well as adhesivity. The amount of the charge transport material used is 20 to 500 parts by weight, preferably 30 to 300 parts by weight, per 100 parts by weight of the resin binder. The layer thickness of the charge transport layer is preferably 3 to 50 $\mu$m, more preferably 15 to 40 $\mu$m, in order to maintain surface potential effective for practical use.

In the present invention, an aryloxydiarylphosphine compound is incorporated into the coating liquid for the charge transport layer and the charge transport layer. Aryloxydiarylphosphine compounds are not known as additives to an electrophotographic photoconductor. However, they are described in U.S. Pat. Nos. 3,809,676 and 3,917,546, Chem. Ber., 129(12), 1547(1996), and Japanese Patent Application Laid-open No. 9-59193 as stabilizers for resin moldings. Of aryloxydiarylphosphine compounds, those having a tert-butyl group are particularly preferred, such as 2,4-di-tert-butylphenoxydiphenylphosphine (Formula 1), 2,6-di-tert-butylphenoxydiphenylphosphine (Formula 2), and 2,6-di-tert-4-methylphenoxydiphenylphosphine (Formula 3).

Formula 1

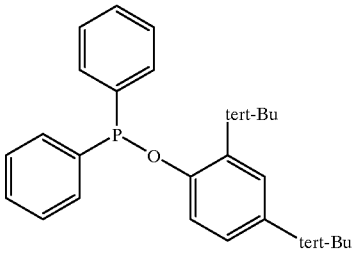

-continued

Formula 2

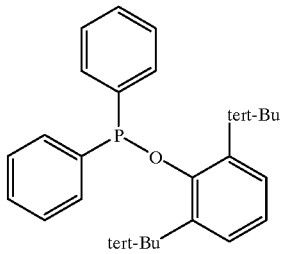

Formula 3

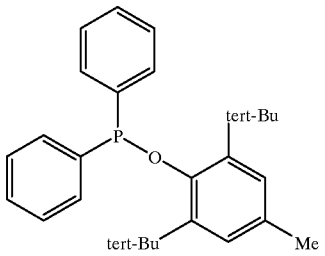

Methods for synthesis of the aryloxydiarylphosphine compounds are publicly known, and these compounds can be synthesized, for example, as described in O. F. Vogl, U.S. Pat. No. 3,917,546, and J. Heinicke, et al., Chem. Ber., 129(12), 1547(1996). The amount of the aryloxydiarylphosphine compound used is preferably 0.005 to 20 parts by weight, more preferably 0.01 to 10 parts by weight, per 100 parts by weight of the charge transport material and the resin binder in the layer containing the charge transport material. If the amount of the aryloxydiarylphosphine compound used is less than 0.005 parts by weight per 100 parts by weight of the charge transport material and the resin binder in the layer containing the charge transport material, the electrophotographic photoconductor does not provide sufficient effects. If this amount exceeds 20 parts by weight, charge transport ability of the electrophotographic photoconductor tends to be decreased remarkably. The mechanism of the marked improvement in the stability of the electrophotographic photoconductor by the addition of the aryloxydiarylphosphine compound to the photosensitive layer is not clearly known, but can be considered as follows: The aryloxydiarylphosphine compound has a higher electron density on the phosphorus atom than a phosphite compound having three oxygen atoms bound to a phosphorus atom. This in turn may enhance the electrophotographic characteristics and the stability of the coating liquid.

The electrophotographic photoconductor with the photosensitive layer of the laminate type has been described above. However, the photosensitive layer containing the charge transport material in the electrophotographic photoconductor of the present invention may be of the single-layer type or of the laminate type, and is not restricted to either type.

The coating liquid containing the charge transport material in the method of production according to the present invention can be applied by various coating methods including dip coating or spray coating The coating method is not restricted to any specific method. The coating liquid incorporating the aryloxydiarylphosphine compound has been improved in stability, and can be stored for a long term.

EXAMPLES

The present invention will now be described in greater detail by way of the following Examples, but it should be understood that the invention is not restricted thereto.

Example 1

70 Parts by weight of polyamide resin (Amilan CM8000, manufactured by TORAY INDUSTRIES Co., Ltd.) and 930 parts by weight of methanol were mixed to prepare a coating liquid for an undercoat. This undercoat coating liquid was applied onto an aluminum substrate by dip coating to form an undercoat with a film thickness after drying of 0.5 $\mu$m.

10 Parts by weight of titanyloxyphthalocyanine (manufactured by FUJI ELECTRIC Co., Ltd.), 686 parts by weight of dichloromethane (manufactured by Wako Pure Chemical Industries Co., Ltd.), 294 parts by weight of 1,2-dichloroethane (manufactured by Wako Pure Chemical Industries Co., Ltd.), and 10 parts by weight of vinyl chloride resin (MR-110, manufactured by Nippon Zeon Co., Ltd.) were mixed, and ultrasonically dispersed to prepare a coating liquid for a charge generation layer. This charge generation layer coating liquid was applied onto the undercoat by dip coating to form a charge generation layer with a film thickness after drying of 0.2 $\mu$m.

100 Parts by weight of 4-(diphenylamino) benzaldehyde phenyl(2-thienylmethyl) hydrazone (manufactured by FUJI ELECTRIC Co., Ltd.), 100 parts by weight of polycarbonate resin (Panlight K-1300, manufactured by Teijin Chemicals Co., Ltd.), 800 parts by weight of dichloromethane, 1 part by weight of a silane coupling agent (KP-340, manufactured by Shin-Etsu Chemical Industries Co., Ltd.), and 4 parts by weight of 2,4-di-tert-butylphenoxydiphenylphosphine (manufactured by FUJI ELECTRIC Co., Ltd.) were mixed to prepare a coating liquid for a charge transport layer. This charge transport layer coating liquid was applied onto the charge generation layer by dip coating to form a charge transport layer with a layer thickness after drying of 20 $\mu$m. In this manner, an electrophotographic photoconductor was produced.

Example 2

A coating liquid for a charge transport layer was prepared in the same manner as in Example 1, except that the amount of 2,4-di-tert-butylphenoxydiphenylphosphine was changed from 4 parts by weight to 0.01 part by weight. Thus, an electrophotographic photoconductor was produced.

Example 3

A coating liquid for a charge transport layer was prepared in the same manner as in Example 1, except that the amount of 2,4-di-tert-butylphenoxydiphenylphosphine was changed from 4 parts by weight to 20 parts by weight. Thus, an electrophotographic photoconductor was produced.

Example 4

A coating liquid for a charge transport layer was prepared in the same manner as in Example 1, except that the amount of 2,4-di-tert-butylphenoxydiphenylphosphine was changed from 4 parts by weight to 40 parts by weight. Thus, an electrophotographic photoconductor was produced.

Example 5

A coating liquid for a charge transport layer was prepared in the same manner as in Example 1, except that 2,4-di-tert-butylphenoxydiphenylphosphine was replaced by 2,6-di-tert-butyl-4-methylphenoxydiphenylphosphine (manufactured by FUJI ELECTRIC Co., Ltd.). Thus, an electrophotographic photoconductor was produced.

Example 6

A coating liquid for a charge transport layer was prepared in the same manner as in Example 5, except that the amount of 2,6-di-tert-butyl-4- methylphenoxydiphenylphosphine was changed from 4 parts by weight to 0.01 part by weight. Thus, an electrophotographic photoconductor was produced.

Example 7

A coating liquid for a charge transport layer was prepared in the same manner as in Example 5, except that the amount of 2,6-di-tert-butyl-4-methylphenoxydiphenylphosphine was changed from 4 parts by weight to 20 parts by weight. Thus, an electrophotographic photoconductor was produced.

Example 8

A coating liquid for a charge transport layer was prepared in the same manner as in Example 5, except that the amount of 2,6-di-tert-butyl-4-methylphenoxydiphenylphosphine was changed from 4 parts by weight to 40 parts by weight. Thus, an electrophotographic photoconductor was produced.

Example 9

An electrophotographic photoconductor was produced in the same manner as in Example 1, except that the resulting coating liquid for a charge transport layer was applied one month after preparation.

Example 10

An electrophotographic photoconductor was produced in the same manner as in Example 2, except that the resulting coating liquid for a charge transport layer was applied one month after preparation.

Example 11

An electrophotographic photoconductor was produced in the same manner as in Example 3, except that the resulting coating liquid for a charge transport layer was applied one month after preparation.

Example 12

An electrophotographic photoconductor was produced in the same manner as in Example 4, except that the resulting coating liquid for a charge transport layer was applied one month after preparation.

Example 13

An electrophotographic photoconductor was produced in the same manner as in Example 5, except that the resulting coating liquid for a charge transport layer was applied one month after preparation.

Example 14

An electrophotographic photoconductor was produced in the same manner as in Example 6, except that the resulting coating liquid for a charge transport layer was applied one month after preparation.

Example 15

An electrophotographic photoconductor was produced in the same manner as in Example 7, except that the resulting coating liquid for a charge transport layer was applied one month after preparation.

Example 16

An electrophotographic photoconductor was produced in the same manner as in Example 8, except that the resulting coating liquid for a charge transport layer was applied one month after preparation.

Comparative Example 1

A coating liquid for a charge transport layer was prepared in the same manner as in Example 1, except that 2,4-di-tert-butylphenoxydiphenylphosphine was not added. Thus, an electrophotographic photoconductor was produced.

Comparative Example 2

An electrophotographic photoconductor was produced in the same manner as in Comparative Example 1, except that the resulting coating liquid for a charge transport layer was applied one month after preparation.

The electric characteristics of the so obtained electrophotographic photoconductors of Examples 1 to 16 and Comparative Examples 1 and 2 were measured with an electrostatic recording paper tester (EPA-8200, manufactured by Kawaguchi Electric Works Co., Ltd.). The electrophotographic photoconductor was subjected to a corona discharge of −5 kV for 10 seconds in the dark for negative charging of its surface at about −600 V. Then, the surface was irradiated with 5 $\mu J/cm^2$ of laser light with a wavelength of 780 nm, whereafter the residual potential was measured. The residual potential at this stage was designated as the initial residual potential. After measurement of this parameter, the electrophotogradhic photoconductor was exposed for 10 minutes to white fluorescent light of 1,000 1 x. The exposed photoconductor was allowed to stand in the dark for 24 hours, whereafter the residual potential was measured similarly. This residual potential was called post-photoexposure residual potential.

Table 1 shows the residual potentials of the respective electrophotographic photoconductors, and evaluations of the stability based on their values. The evaluation ○ represents excellent stability, and X poor stability.

| | INITIAL RESIDUAL POTENTIAL (V) | POST-PHOTOEXPOSURE RESIDUAL POTENTIAL (V) | EVALUATIONS |
|---|---|---|---|
| Example 1 | −18 | −18 | ○ |
| Example 2 | −18 | −19 | ○ |
| Example 3 | −20 | −21 | ○ |
| Example 4 | −39 | −39 | ○ |
| Example 5 | −18 | −17 | ○ |
| Example 6 | −16 | −16 | ○ |
| Example 7 | −18 | −19 | ○ |
| Example 8 | −37 | −38 | ○ |
| Example 9 | −19 | −19 | ○ |
| Example 10 | −19 | −19 | ○ |
| Example 11 | −20 | −21 | ○ |
| Example 12 | −39 | −40 | ○ |
| Example 13 | −17 | −17 | ○ |
| Example 14 | −18 | −19 | ○ |
| Example 15 | −18 | −18 | ○ |
| Example 16 | −38 | −39 | ○ |
| Comparative Example 1 | −20 | −43 | X |
| Comparative Example 2 | −48 | −66 | X |

As shown in Table 1, the residual potentials did not change after photoexposure in all the Examples, while the residual potentials increased much after photoexposure in the Comparative Examples. Further, comparing the photoconductors using one month-stored coating liquid with those using as-prepared coating liquid, both initial and post-photoexposure residual potentials were not different in all the Examples, while those potentials were greatly different in the Comparative Examples. Thus, it has been demonstrated that stability to photoexposure and long-term stability of the coating liquid are achieved by incorporating aryloxydiarylphosphine compound in a photosensitive layer.

According to the present invention, as stated earlier, an aryloxydiarylphosphine compound is incorporated into a layer containing a charge transport material in an electrophotographic photoconductor having a photosensitive layer comprising the layer on a conductive substrate. Thus, the invention can obtain an electrophotographic photoconductor with highly stable electrophotographic characteristics.

According to the present invention, moreover, an aryloxydiarylphosphine compound is incorporated into a coating liquid containing a charge transport material in a method for producing an electrophotographic photoconductor which includes the step of applying the coating liquid onto a conductive substrate to form a photosensitive layer. Thus, the invention can obtain a method for producing an electrophotographic photoconductor which imparts high stability to a coating liquid.

The present invention has been described in detail with respect to various embodiments, and it will now be apparent from the foregoing to those skilled in the art that changes and modifications may be made without departing from the invention in its broader aspects, and it is our intention, therefore, in the appended claims to cover all such changes and modifications as fall within the true spirit of the invention.

What is claimed is:

1. An electrophotographic photoconductor having a photosensitive layer on a conductive substrate, said photosensitive layer comprising a layer containing a charge transport material and an aryloxydiarylphosphine compound.

2. The electrophotographic photoconductor as claimed in claim 1, wherein the content of said aryloxydiarylphosphine compound is 0.005 to 20 parts by weight per 100 parts by weight of the charge transport material and a resin binder in said layer containing the charge transport material and the aryloxydiarylphosphine compound.

3. The electrophotographic photoconductor as claimed in claim 2, wherein said aryloxydiarylphosphine compound is 2,4-di-tert-butylphenoxydiphenylphosphine.

4. The electrophotographic photoconductor as claimed in claim 2, wherein said aryloxydiarylphosphine compound is 2,6-di-tert-butylphenoxydiphenylphosphine.

5. The electrophotographic photoconductor as claimed in claim 2, wherein the content of said aryloxydiarylphosphine compound is 0.01 to 10 parts by weight per 100 parts by weight of the charge transport material and a resin binder in said layer containing the charge transport material and the aryloxydiarylphosphine compound.

6. The electrophotographic photoconductor as claimed in claim 5, wherein said aryloxydiarylphosphine compound is 2,4-di-tert-butylphenoxydiphenylphosphine.

7. The electrophotographic photoconductor as claimed in claim 5, wherein said aryloxydiarylphosphine compound is 2,6-di-tert-butylphenoxydiphenylphosphine.

8. The electrophotographic photoconductor as claimed in claim 1, wherein said aryloxydiarylphosphine compound is 2,4-di-tert-butylphenoxydiphenylphosphine.

9. The electrophotographic photoconductor as claimed in claim 1, wherein said aryloxydiarylphosphine compound is 2,6-di-tert-butylphenoxydiphenylphosphine.

10. A method for producing an electrophotographic photoconductor, including the step of applying a coating liquid containing a charge transport material onto a conductive substrate to form a photosensitive layer, said method further comprising incorporating an aryloxydiarylphosphine compound into said coating liquid.

* * * * *